US008690605B2

(12) United States Patent
Wang et al.

(10) Patent No.: US 8,690,605 B2
(45) Date of Patent: Apr. 8, 2014

(54) I/O CONNECTOR HAVING METAL COVERING PORTION TIGHTLY FIXED WITH INSULATIVE HOUSING

(75) Inventors: Fei Wang, Shenzhen (CN); Hua-Ping Li, Shenzhen (CN); Yusho Nakase, Yokohama (JP)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 130 days.

(21) Appl. No.: 13/340,607

(22) Filed: Dec. 29, 2011

(65) Prior Publication Data

US 2012/0171901 A1 Jul. 5, 2012

(30) Foreign Application Priority Data

Dec. 30, 2010 (CN) ..... 2010 2 0690508
Dec. 30, 2010 (CN) ..... 2010 2 0690519

(51) Int. Cl.
*H01R 13/648* (2006.01)

(52) U.S. Cl.
USPC ..... 439/607.37; 439/607.27

(58) Field of Classification Search
USPC ..... 439/607.37, 607.27, 660, 79, 607.35, 439/607.36, 607.4, 540.1, 541.5, 607.07, 439/607.09, 607.11, 607.13, 607.24, 439/607.32, 607.34, 607.51, 607.57
See application file for complete search history.

(56) References Cited

U.S. PATENT DOCUMENTS

| | | | | |
|---|---|---|---|---|
| 5,474,472 | A * | 12/1995 | Niwa et al. | 439/607.08 |
| 6,074,225 | A * | 6/2000 | Wu et al. | 439/101 |
| 6,305,978 | B1 * | 10/2001 | Ko et al. | 439/579 |
| 7,402,081 | B2 * | 7/2008 | Si et al. | 439/607.04 |
| 7,422,475 | B2 * | 9/2008 | Hirata | 439/541.5 |
| 7,682,199 | B2 | 3/2010 | Ahn et al. | |

* cited by examiner

*Primary Examiner* — Renee Luebke
*Assistant Examiner* — Harshad Patel
(74) *Attorney, Agent, or Firm* — Wei Te Chung; Ming Cheih Chang

(57) ABSTRACT

An I/O connector (100) includes an insulative housing (10) having a base portion (11) and a fitting portion (12) extending forwardly from the base portion, a number of terminals (30) retained in the insulative housing, and a metal covering portion (20) integrally molded with the insulative housing. The metal covering portion has a main portion (21) embedded with the base portion, a pair of deflexed side portions (22) engaging with two sides of the fitting portion, and a front portion (23) engaging with a front edge of the fitting portion. The main portion defines a slit (212) and forms a corresponding slant portion (213) extending into the slit. The fitting portion forms an upper hook (124). The upper hook is received in the slit and engages with the slant portion.

9 Claims, 8 Drawing Sheets

I/O CONNECTOR HAVING METAL COVERING PORTION TIGHTLY FIXED WITH INSULATIVE HOUSING

BACKGROUND OF THE INVENTION

1. Field of the Invention

The present invention relates generally to an I/O (Input/Output) connector, and more particularly to an I/O connector having a metal covering portion tightly fixed with an insulative housing.

2. Description of Related Arts

According to minimization of electronic products, an electrical connector of a reduced size is provided on the electronic product. An I/O connector usually comprises an insulative housing, a plurality of terminals retained in the insulative housing, and a metal shell assembling outside of the insulative housing for defining a mating space. The insulative housing includes a fitting portion extending forward into the mating space for engaging with a mating connector. However, the fitting portion usually has a small thickness such that the fitting portion is prone to be deformed when the mating connector is inserted.

U.S. Pat. No. 7,682,199 discloses an I/O connector comprising an insulative housing having a fitting portion and a metal covering portion provided on the fitting portion of the insulative housing for protection. The fitting portion has upper and lower main surfaces and a pair of side surfaces connecting those main surfaces. The metal covering portion is rigid and prevents the fitting portion from being damaged when a mating connector is inserted. The metal covering portion is integrally formed with the insulative housing by molding and extends along the periphery of the fitting portion to cover the lower main surface and the pair of side surfaces. The metal covering portion further extends from the pair of respective side surfaces to only cover end portions of the upper main surface. The great middle part of the upper main surface of the fitting portion is not covered by the metal covering portion. In other words, the metal covering portion is engaged with the insulative housing at the end portions. Therefore, the great middle part of the upper main surface of the fitting portion is still prone to be wrapped and separate from the metal covering portion. The metal covering portion does not protect the great middle part of the fitting portion. The I/O connector is even not useable when the great middle part of the upper main surface of the fitting portion seriously separates from the metal covering portion.

Hence, an I/O connector which has a metal covering portion tightly fixed with an insulative housing is desired.

SUMMARY OF THE INVENTION

Accordingly, an object of the present invention is to provide an I/O connector which has a metal covering portion tightly fixed with an insulative housing.

To achieve the above object, an I/O connector includes an insulative housing having a base portion and a fitting portion extending forwardly from the base portion, a number of terminals retained in the insulative housing, and a metal covering portion integrally molded with the insulative housing. The metal covering portion has a main portion embedded with the base portion, a pair of deflexed side portions engaging with two sides of the fitting portion, and a front portion engaging with a front edge of the fitting portion. The main portion defines a slit and forms a corresponding slant portion extending into the slit. The fitting portion forms an upper hook. The upper hook is received in the slit and engages with the slant portion.

Other objects, advantages and novel features of the invention will become more apparent from the following detailed description when taken in conjunction with the accompanying drawings.

DETAILED DESCRIPTION OF THE PREFERRED EMBODIMENT

Figure 1:
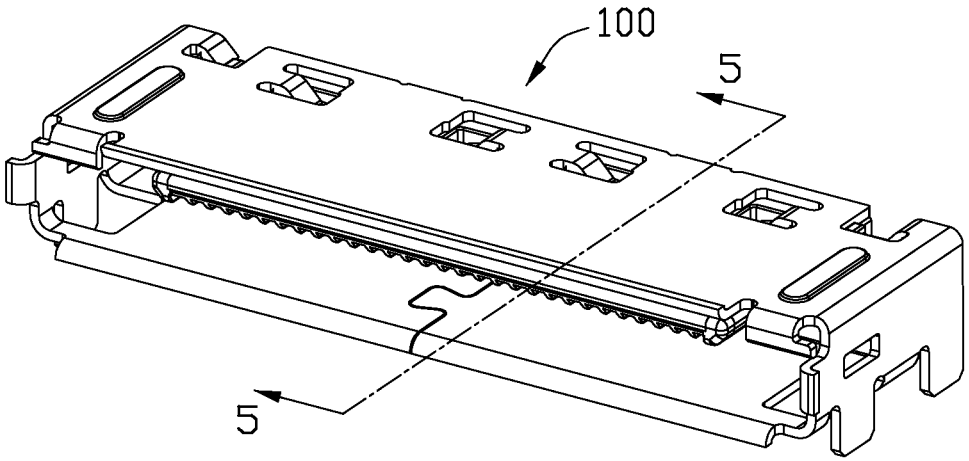
FIG. 1 is a perspective, assembled view of an I/O connector constructed in accordance with the present invention.

Reference will now be made in detail to the preferred embodiment of the present invention.

Referring to FIGS. 1-8, an I/O connector 100 comprises an insulative housing 10, a metal covering portion 20 integrally molding with the insulative housing 10, a plurality of terminals 30 retained in the insulative housing 10, and a metal shell 40 covering the insulative housing 10.

Figure 3:
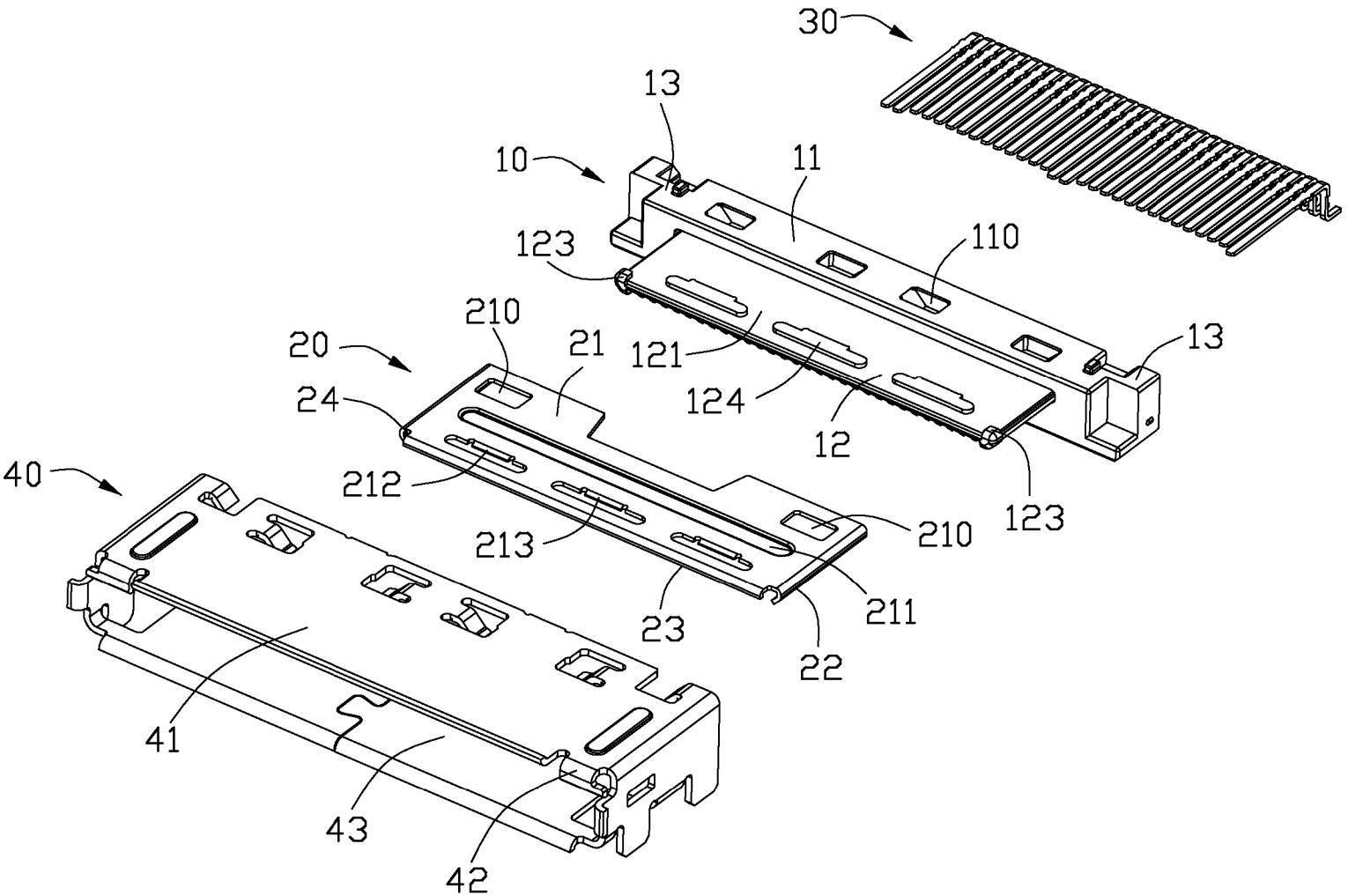
FIG. 3 is a perspective, fully exploded view of the I/O connector.
Figure 4:
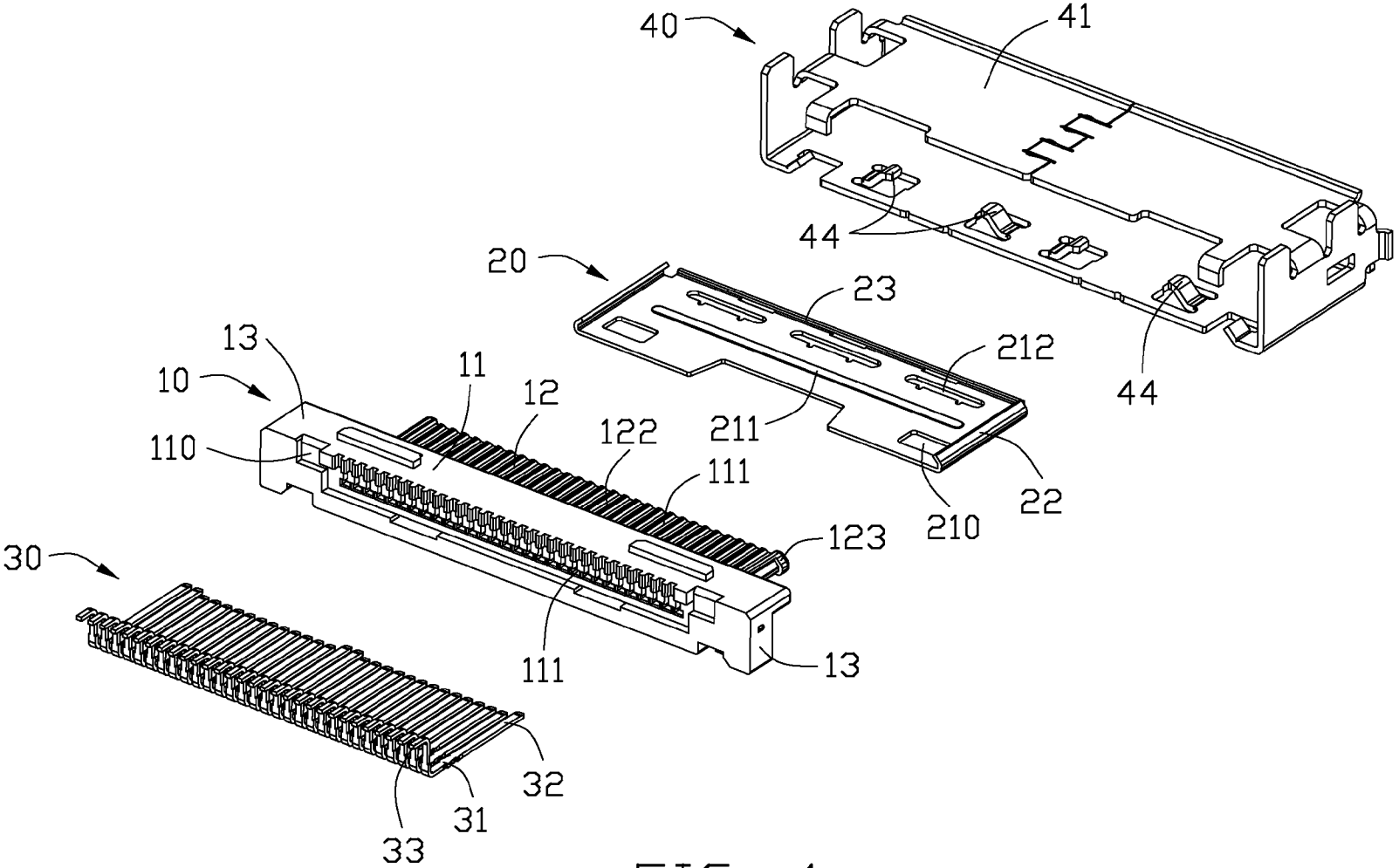
FIG. 4 is another perspective, fully exploded view of the I/O connector.
Figure 5:
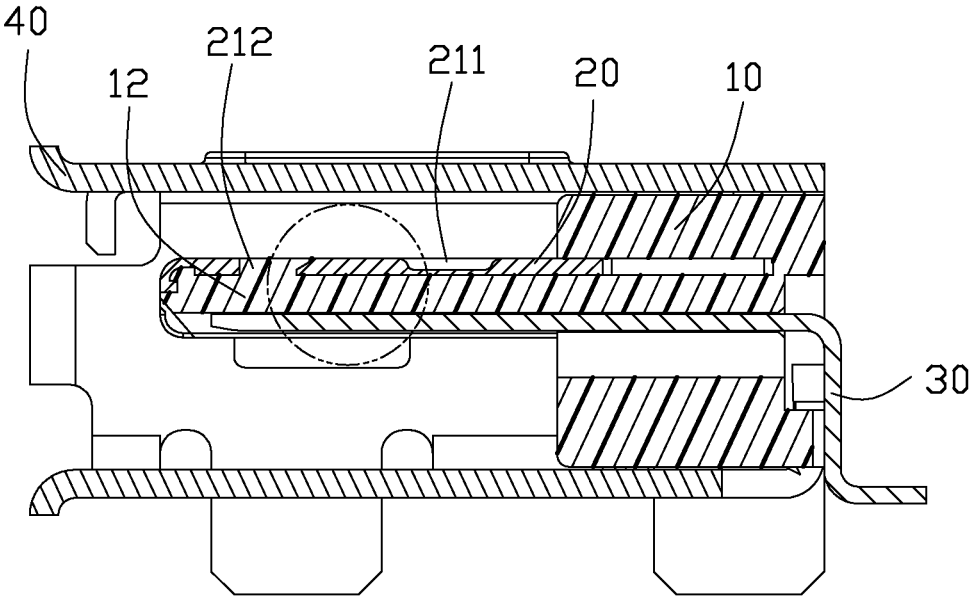
FIG. 5 is a cross sectional view of the I/O connector taken along line 5-5 of FIG. 1.
Figure 6:
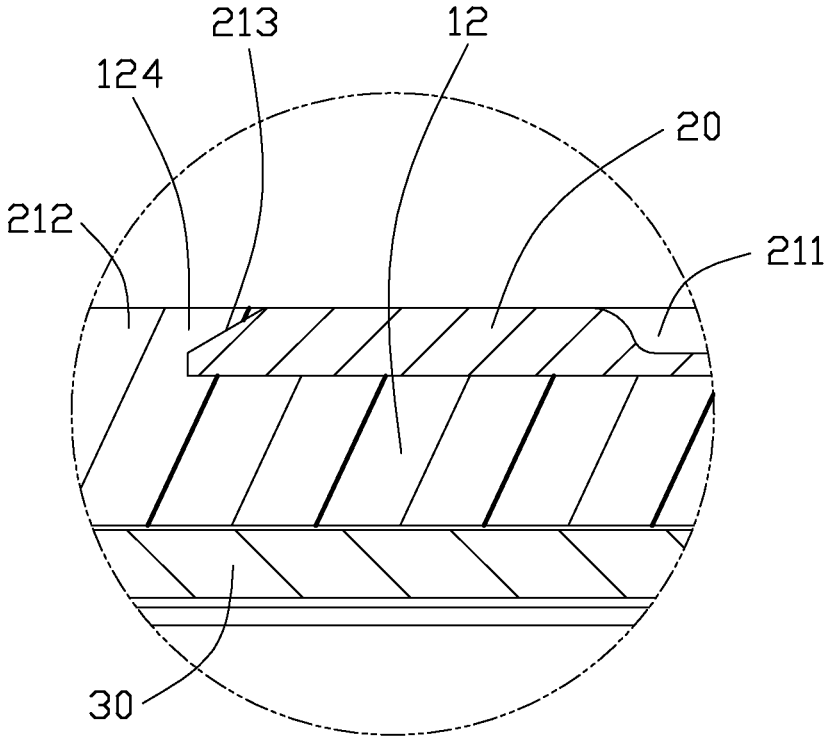
FIG. 6 is an enlarged view of the broken line of FIG. 5.
Figure 7:
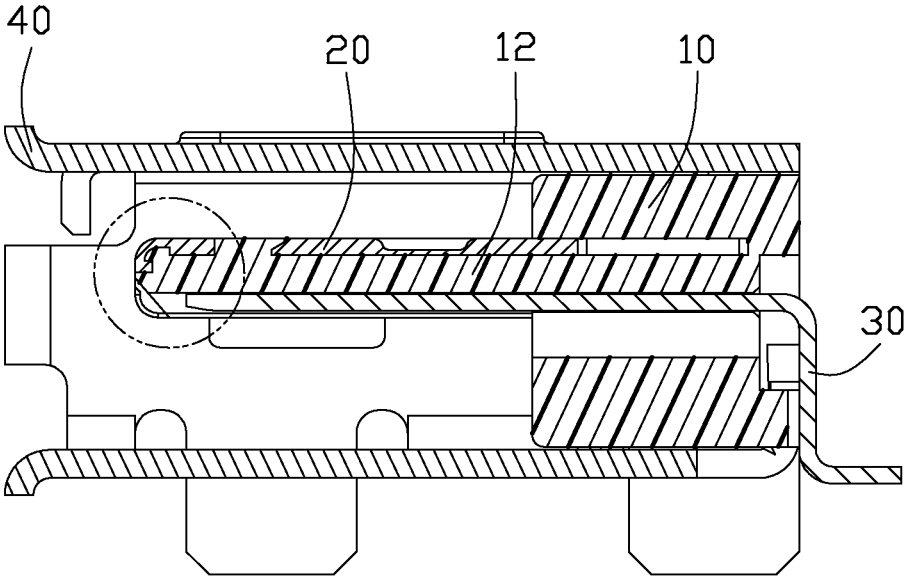
FIG. 7 is a cross sectional view having a different broken line with respect to FIG. 5.
Figure 8:
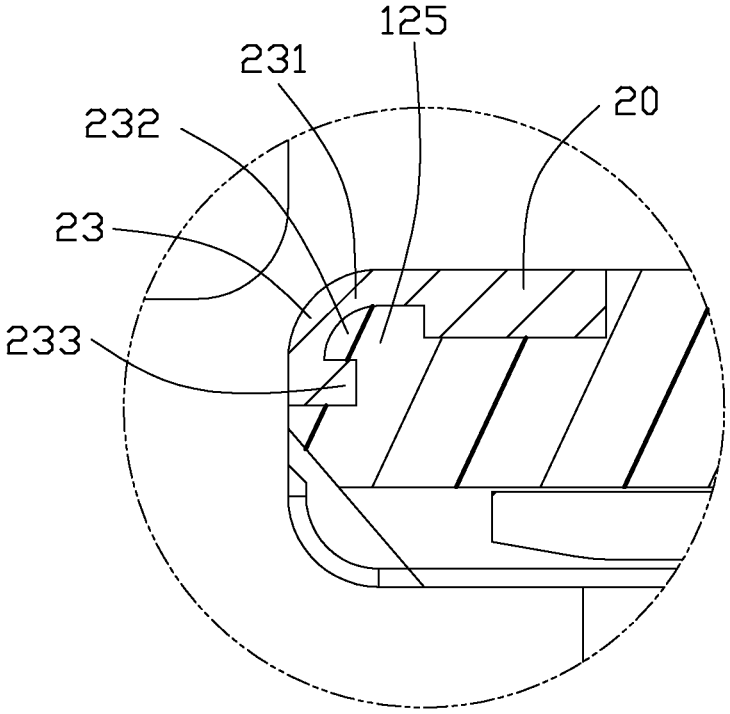
FIG. 8 is an enlarged view of the broken line of FIG. 7.

Referring to FIGS. 3 and 4, the insulative housing 10 comprises an elongated base portion 11, a pair of shoulder portions 13 integrally formed at two ends of the base portion 11, and a fitting portion 12 extending forwardly from the base portion 11. The base portion 11 defines a plurality of cutouts 110 at both upper face and rear face thereof The insulative housing 10 defines a plurality of passageways 111 extending through the base portion 11 and the fitting portion 12. The passageways 11 are exposed at a lower face of the fitting portion 12. The metal covering portion 20 is attached at the upper face of the fitting portion 12. A pair of protrusions 123 is formed at front side corners of the fitting portion 12. A plurality of upper hooks 124 is formed on the upper face of the fitting portion 121.

Figure 2:
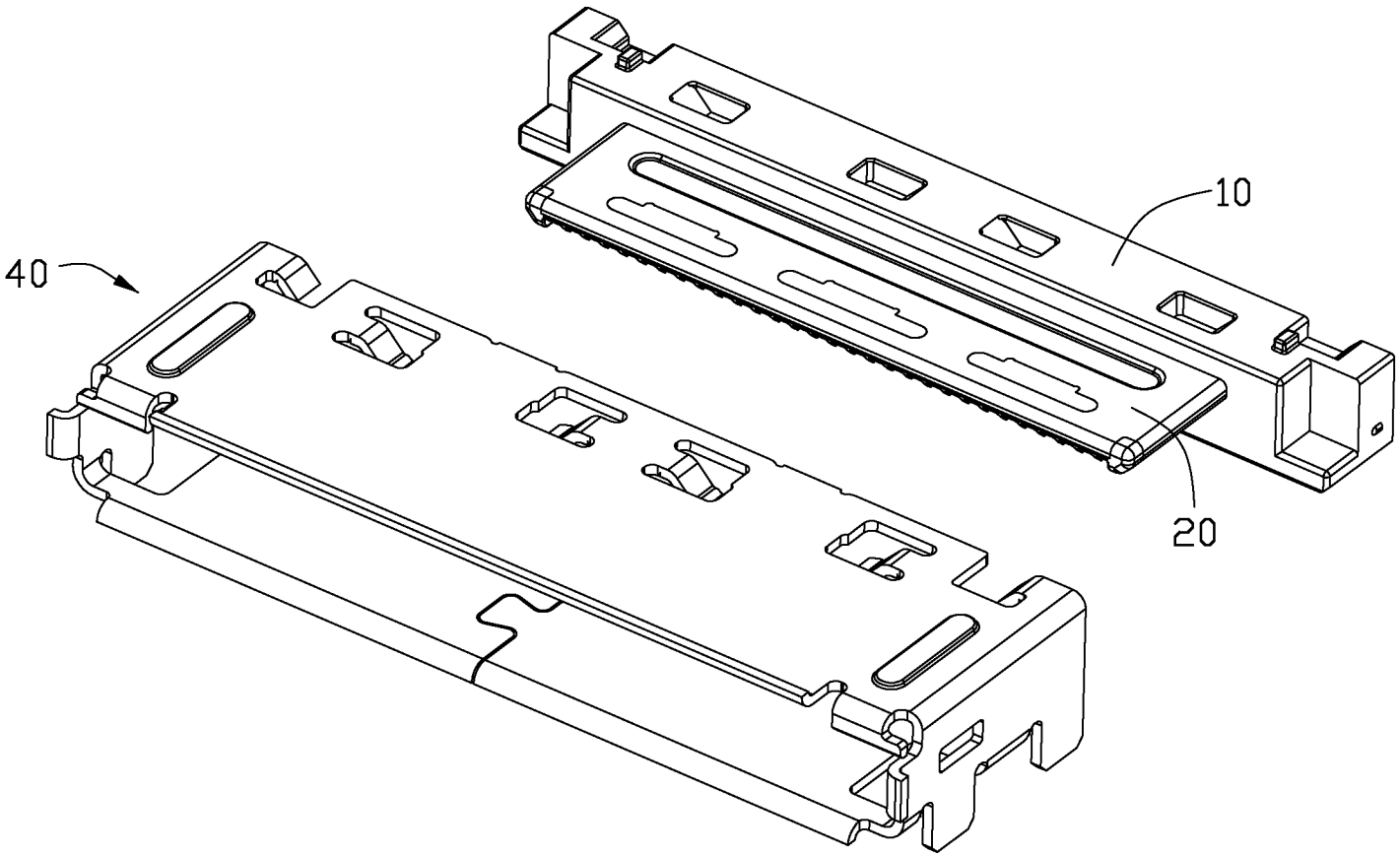
FIG. 2 is a perspective, partly exploded view of the I/O connector.

Referring to FIGS. 2-4, the terminals 30 are retained in the passageways 111 of the insulative housing 10. Each terminal 30 comprises a retaining portion 31, a contacting portion 32 extending forward and straightly from the retaining portion 31, and a soldering portion 33 bending rearward and curvedly from the retaining portion 31. The soldering portions 33 extend beyond the base portion 11 of the insulative housing 10 for soldering on a printed circuit board (not shown). The contacting portions 31 extend below the fitting portion 12 of the insulative housing 10 for connecting with a mating connector (not shown).

Referring to FIGS. 3 and 4, the metal covering portion 20 is integrally formed with the insulative housing 10 by molding. The metal covering portion 20 comprises a main portion 21, a pair of deflexed side portions 22 engaging with two sides of the fitting portion 12, and a deflexed front portion 23 engaging with a front edge of the fitting portion 12. The metal covering portion 20 defines a notch 24 at each front corner of the main portion 21 and the deflexed side portions 22. The notch 24 receives the protrusion 123 for orienting the metal covering portion 20 and the insulative housing 10. The main portion 21 defines a pair of holes 210, a recessed portion 211 and a plurality of slits 212 when taken a view along a first direction opposite to a mating direction along which the mating connector is inserted. The holes 210 are dispersed around each deflexed side portion 22. The recessed portion 211 extends along a second direction perpendicular to the mating direction with two ends approximate to the deflexed side portions 22. The slits 212 are three numbered in a preferred embodiment. The slits 212 extend along the second direction too and are arranged in a line. The metal covering portion 20 has a plurality of slant portions 213 extending forwardly into corresponding slits 212.

The metal shell 40 is frame shaped and shields over the insulative housing 10. The metal shell 40 comprises a casing portion 41 fabricating from a metal piece. The casing portion 41 defines a receiving space 43 with a front insertion opening (not labeled) for inserting the mating connector and a rear insertion opening (not labeled) for inserting the insulative housing 10. A plurality of locking portions 44 is stamped on the casing portion 41. A guiding portion 42 extends curvedly from the casing portion 41 into the receiving space 43. Furthermore, the guiding portion 42 is formed at the insertion opening for guiding the mating connector.

Referring to FIGS. 3-8, during the metal covering portion 20 is molded with the insulative housing 10, plastic material is filled in the cutouts 210 of the metal covering portion 20. Therefore, a rear part of the metal covering portion 20 is embedded with the base portion 11 of the insulative housing 10. Plastic material is filled in the slits 212. Therefore, the upper hooks 124 are received in the corresponding slits 212 and engage with the slant portions 213 of the metal covering portion 20 for securing the insulative housing 10 and the metal covering portion 20. Because the slant portions 213 of the metal covering portion 20 extend below the upper hooks 124, the metal covering portion 20 is prevented from loosening from the insulative housing 10. Furthermore, the deflexed front portion 23 of the metal covering portion 20 is forged to have a slot 232 and a clapping portion 233. The clapping portion 233 extends rearward and parallel with the main portion 21. Plastic material is filled in the slot 232 of the metal covering portion 20 to form a block 125. The block 125 is engaged with the clapping portion 233 along a vertical direction perpendicular to both the second direction and the mating direction. The metal covering portion 20 is prevented from loosening from the insulative housing 10, too. Therefore, the metal covering portion 20 is tightly fixed with the insulative housing 10.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An I/O connector comprising:

an insulative housing having a base portion and a fitting portion extending forwardly from the base portion, the fitting portion forming an upper hook;

a plurality of terminals retained in the insulative housing; and a metal covering portion integrally molded with the insulative housing, the metal covering portion having a main portion embedded with the base portion, a pair of deflexed side portions engaging with two sides of the fitting portion, and a deflexed front portion engaging with a front edge of the fitting portion, the main portion defining a slit and forming a corresponding slant portion extending into the slit; wherein the upper hook is received in the slit and engages with the slant portion, the slant portion extends below the upper hook, and the fitting portion forms a protrusion at each front side corner thereof, and the metal covering portion defines a respective notch receiving the protrusion.

2. The I/O connector as claimed in claim 1, wherein the deflexed front portion has a clapping portion and the insulative housing forms a block engaged with the clapping portion.

3. The I/O connector as claimed in claim 1, wherein the clapping portion extends rearward and parallel with the main portion.

4. The I/O connector as claimed in claim 1, wherein the deflexed front portion defines a slot receiving the block.

5. The I/O connector as claimed in claim 1, further comprising a metal shell covering outside of the insulative housing.

6. An I/O connector comprising:

an insulative unitary housing defining a base with a mating tongue forwardly extending therefrom and defining two opposite surfaces thereon;

a plurality of passageways formed in the housing and extending into one of said two surfaces;

a plurality of contacts disposed in the corresponding passageways, respectively; and a metallic shell attached to the other of said two surfaces and defining three curved rim sections protectively disposed upon two opposite side edges and a front edge of said mating tongue; wherein said mating tongue defines a protrusion extending through the shell in a snug manner for preventing movement of the shell relative to the mating tongue in a front-to-back direction, said protrusion further equipped with a dovetailed structure to abut against the shell for preventing movement of the shell relative to the mating tongue in a vertical direction perpendicular to said front-to-back direction.

7. The I/O connector as claimed in claim 6, wherein said shell is assembled with said mating tongue via an insert molding process.

8. The I/O connector as claimed in claim 6, wherein the mating tongue defines a projection a corner of the front edge adjacent to the other of said two surfaces, and said projection is sandwiched by the shell in both the vertical direction and the front-to-back direction.

9. The I/O connector as claimed in claim 8, wherein said shell is assembled with said mating tongue via an insert molding process.

* * * * *